United States Patent [19]

Stahlecker et al.

[11] Patent Number: 4,974,409

[45] Date of Patent: Dec. 4, 1990

[54] PROCESS FOR PRODUCING A TWISTED YARN FEED SPOOL

[75] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[73] Assignees: Fritz Stahlecker; Hans Stachlecker, Fed. Rep. of Germany

[21] Appl. No.: 313,538

[22] Filed: Feb. 22, 1989

Related U.S. Application Data

[62] Division of Ser. No. 140,760, Jan. 4, 1988, Pat. No. 4,854,523.

[30] Foreign Application Priority Data

Jan. 6, 1987 [DE] Fed. Rep. of Germany ..... 3700186

[51] Int. Cl.[5] ..... D01H 1/115; D01H 5/28

[52] U.S. Cl. ..... 57/328; 57/5; 57/293

[58] Field of Search ..... 57/204, 205, 328–331, 57/294, 293, 5, 6

[56] References Cited

U.S. PATENT DOCUMENTS

| | | | |
|---|---|---|---|
| 4,003,194 | 1/1977 | Yamagata et al. | 57/328 |
| 4,142,354 | 3/1979 | Nakahaka | 57/328 |
| 4,183,202 | 1/1980 | Morihashi | 57/328 |
| 4,484,436 | 11/1984 | Nakayama et al. | 57/328 |
| 4,598,537 | 7/1986 | Kroupa et al. | 57/328 X |

*Primary Examiner*—John Petrakes

*Attorney, Agent, or Firm*—Evenson, Wands, Edwards, Lenahan & McKeown

[57] ABSTRACT

In the case of a process for producing a twisted yarn from slivers that are drawn to the desired size and subsequently are prestrengthened by means of pneumatic false twisting, it is provided that the fiber ends in the form of helixes are wound around the core with such a steep slope that, during the twisting, the fiber ends that were previously wound around the core are wound off the core as much as possible.

6 Claims, 3 Drawing Sheets

PROCESS FOR PRODUCING A TWISTED YARN FEED SPOOL

BACKGROUND AND SUMMARY OF THE INVENTION

The invention relates to a process and apparatus for producing a twisted yarn from two slivers that are drawn to the desired size and are subsequently prestrengthened by means of pneumatic false twisting, the fiber ends being wound around the essentially unturned core, after which the prestrengthened slivers are twisted together with one another in such a way that the twisting turn is opposed to the winding-around direction, and to a feed spool for the twisting. The invention also relates to the twisted yarn feed spool formed by the process.

It is known (EP-A-38 143) to draw two slivers in a drafting frame to the desired size. Subsequently, these slivers, by means of pneumatic false twisting, are provided with a prestrengthening by means of which fiber ends are wound around the essentially unturned core of the slivers. The resulting prestrengthening of the slivers is so low that they cannot be used as individual threads or individual yarns. In the case of the known process, it is provided that the resistance to tearing of the finished twisted yarn is between 150% and 250% of the doubled, not yet twisted-together individual component. In the case of the known process, it is also provided that the twisting turn is opposed to the winding-around direction of the fiber ends so that during the twisting, the bundling is weakened that is obtained by the winding-around of the fiber ends. Since, however, in the case of the known process, the fiber ends are wound around in the form of spirals, i.e., essentially in a radial plane with respect to the core, this weakening of the bundling effect can hardly be achieved. In the case of the known process, it is therefore provided that wind-around fibers are wound around less than 50% and preferably less than 30% of the length of the slivers. This has the objective that subsequently, after the twisting, a yarn is created that is not very hard, like the known air yarns, but has an improved feel. However, in the case of this process, a relatively uneven twisted yarn is obtained that in the areas, in which the winding-around is present, has a hard feel but otherwise has a soft feel.

The invention is based on an objective of providing a process of the initially mentioned type in which a sufficiently firm, but at the same time voluminous yarn is obtained that has a high uniformity.

This objective is achieved by the fact that the fiber ends, in the form of helixes, are wound around the core with such a steep slope during the prestrengthening by pneumatic false twisting that, during the subsequent yarn twisting operation, the fiber ends that were previously wound around the core are as much as possible wound off the core.

By means of the helical winding-around during the prestrengthening, the advantageous effect is achieved that the slivers are prestrengthened over their length in a more uniform way. In addition, the special advantage is achieved that the areas that were surrounded by the winding during the prestrengthening, during the subsequent introduction of the twist, are loosened up again, because the winding-around is practically undone.

In a further development of the invention, it is provided that the predominant part of the fiber ends that were wound around the core of the sliver during the prestrengthening form helixes of an angle of slope of 45° and more. This has the result that also these areas are reduced in which the winding-around sliver ends wind mutually around one another so that the opening-up of these windings is improved further during the twisting.

In a further development of the invention, it is provided that, during the prestrengthening, fiber ends are wound around the core of each of the slivers over the predominant part of the length and as uniformly as possible. As a result, the uniformity of the prestrengthened slivers and mainly the uniformity of the twisted yarn obtained later is improved significantly.

Other objects, advantages and novel features of the present invention will become apparent from the following detailed description of the invention when considered in conjunction with the accompanying drawings.

DETAILED DESCRIPTION OF THE DRAWINGS

Figure 1:
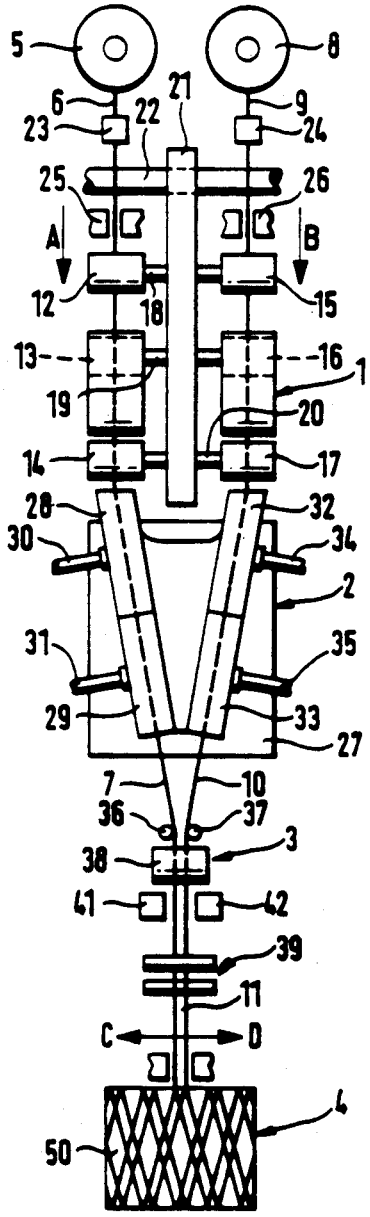
FIG. 1 is a diagrammatic representation of an arrangement for carrying out the process according to the invention.

The arrangement shown in FIG. 1, of which a machine has a plurality of similar devices arranged next to one another, contains, in tandem in moving direction of the fiber material to be processed, a drafting frame 1, a twisting zone 2, a withdrawal device 3 and a spooling or winding device 4. By means of this arrangement, two slivers 6, 9 are drawn to the desired size and prestrengthened and subsequently are wound jointly in a multiple-wound form onto a cross-wound spool 50.

The slivers 6, 9 are taken from feed spools 5, 8 or alternatively out of sliver cans and introduced into the drafting frame 1.

The drafting frame 1 contains bottom cylinders that are not shown and that pass through and are driven in the longitudinal direction of the machine, to which top rollers (12, 15), (13, 16) and (14, 17) that are developed as pressure roller pairs are assigned for the two slivers 6, 9. In the main drafting zone, tape guides are provided. The shafts 18, 19, 20 of the pressure roller pairs are disposed in a joint weighting arm 21 that can be swivelled around a rod 22 that passes through in the longitudinal direction of the machine so that the drafting frame 1 can be opened. Sliver guards 23, 24 are connected in front of the drafting frame 1 that control sliver clamps 25, 26 arranged in the feeding area in front of the feeding top rollers 12, 15, and that monitor the feeding of a sliver 6, 9. If it is determined that a sliver 6, 9 is absent, both sliver clamps 25, 26 are actuated so that the continued process is interrupted.

In the area of a twisting zone 2, a total of four air nozzles 28, 29, 32 and 33 are arranged in pairs on a joint supporting plate 27. Of these, two air nozzles respectively that are arranged behind one another are assigned to respective slivers 6, 9. The air nozzles 28, 32 that directly follow the drafting frame 1 and that are connected to compressed-air supply lines 30, 34, are developed as so-called intake nozzles. These nozzles 28, 32 generate an injection air flow that acts essentially in the moving direction (A, B) of the slivers 6, 9 and provide the slivers 6, 9 with practically no twist, or no more than a slight twist.

The air nozzles 29, 33 that follow the air nozzles 28, 32 and that are connected to compressed-air supply lines 31, 35, are constructed as so-called false-twisting nozzles that provide the slivers 6, 9, that were drawn to the desired size in the drafting frame 1, with a false twist by means of an air whirl that is generated in them and has a predetermined direction. In this case, both slivers 6, 9, receive a false twist in the same direction in the air nozzles 29, 33. Within the twisting zone 2, the slivers 6, 9 receive a prestrengthening that will be explained in greater detail below.

The air nozzles 28, 29; 32, 33 are arranged so that they converge in a V-shape and so that the prestrengthened slivers 7, 10 can approach one another as early as in the area of the false-twisting zone 2. These prestrengthened slivers 7, 10 are guided subsequently by means of yarn guides 36, 37 farther toward one another so that they move next to one another at a close distance. The yarn guides 36, 37 are followed by the withdrawal device 3 that comprises a bottom cylinder that is not shown and passes through and is driven in the longitudinal direction of the machine, a pressure roller 38 being assigned to this bottom cylinder at each arrangement that is elastically pressed against it.

The wind-on device 4 that follows contains a yarn guide that traverses in the direction of the Arrows (C, D) and in front of which a compensating device 39 is connected that compensates the different lengths of the formed double yarn 11 that are present during the traversing.

In the area behind the withdrawal device 3, a yarn monitoring device 41, 42 is also arranged that is designed in such a way that it responds as early as during a breakage of a prestrengthened sliver 7, 10 and then actuates both sliver clamps 25, 26 so that not only one of the prestrengthened slivers 7, 10 alone is wound onto the cross-wound spool 50.

The cross-wound spool 50, onto which the two prestrengthened yarn components 7, 10 are wound in a multiple-wound way as a double yarn 11, is used as a feed spool for a subsequent twisting by means of a known twisting machine, such as a double-twist frame.

The prestrengthening in the twisting zone 2 takes place in such a way that fiber ends of fibers anchored in the slivers 6, 9 are spread away from the slivers 6, 9 and are wound around the core of the sliver 7, 10.

Figure 2:
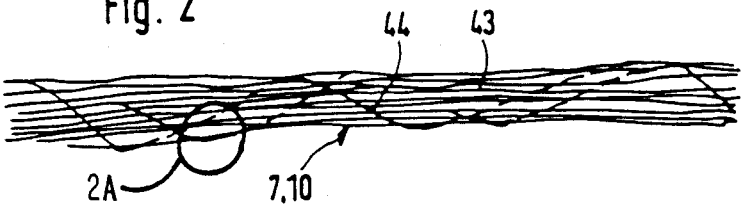
FIG. 2 is a very enlarged diagrammatic representation of a prestrengthened sliver formed in accordance with a preferred embodiment of the present invention with a helical winding around of radially outward fibers around the core of sliver fibers.

As shown in FIG. 2, the twisting zone 2 is operated in such a way that the fiber ends 44 are wound around the core 43, that consists essentially of unturned fibers that are disposed in parallel to one another, this winding taking place in the form of steep helixes. In this case, it is endeavored that, on the one hand, not too many fiber ends 44 are spread away and wound around the core 43, while, on the other hand, the winding-around must be distributed as uniformly as possible over the length of the slivers 7, 10. The steepness of the helixes can be affected particularly by the blowing direction of the blow-out openings of the air nozzle 29, 33, as well as the applied excess pressure. In this case, the blowing direction may be selected in such a way that the openings can blow out into a joint radial plane or have a component in the moving direction (A, B) of the slivers 6, 9. In addition, the steepness of the helixes can be controlled by the passing-through speed of the slivers 6, 9 by means of which these are guided through the twisting zone 2. Also important is the yarn tension in the twisting zone 2 that is determined by the delivery speed at the outlet of the drafting frame 1 and the withdrawal speed of the withdrawal device 3. This speed ratio is dimensioned in such a way that a negative draft of about 0% to 3% exists in the twisting zone. Particularly, by the adjustment of this negative draft, it is possible to influence the number of the fiber ends that are wound around. In addition, the winding-around of fiber ends and thus the steepness of the helixes can be influenced by frictional relationships, i.e., by the frictional relationships between the interior walls, particularly of the air nozzles 29, 33, and the fibers.

Figure 2A:
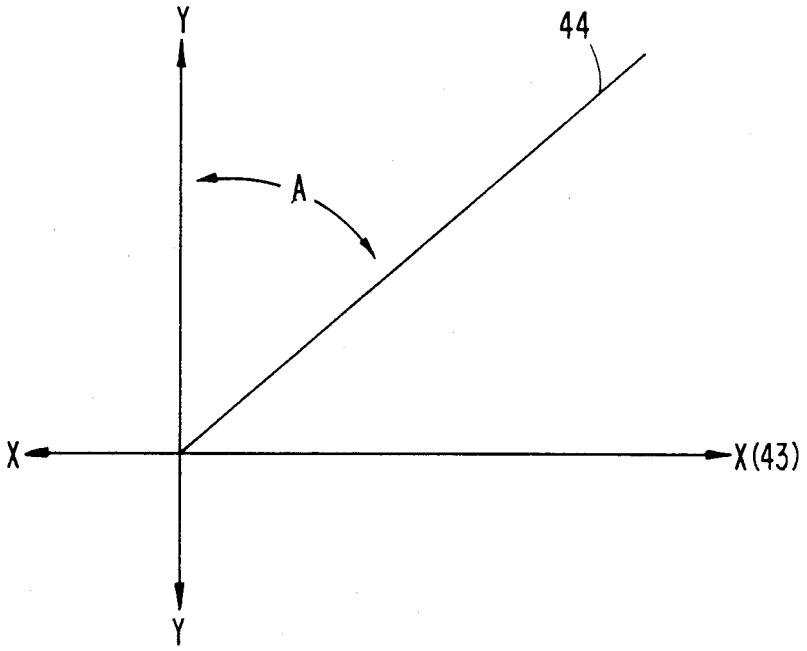
FIG. 2A is a schematic view of section 2A of FIG. 2 and showing the helical winding angle of the radially outward wound around fibers.

FIG. 2A schematically depicts the steepness angle A between the radius of the sliver (axis y—y) and the vertical inclination of the wrapped around fiber ends 44. The x—x axis of FIG. 1A corresponds to the longitudinal direction of the sliver core 43. In especially preferred embodiments, this helix angle is 45° or more.

In practice, it is possible to examine the winding-around and the steepness of the helixes with which the fiber ends 44 are wound around the core 43, for example on yarn samples by means of a microscope, and then to adjust one or several of the above-mentioned parameters.

Figure 3:
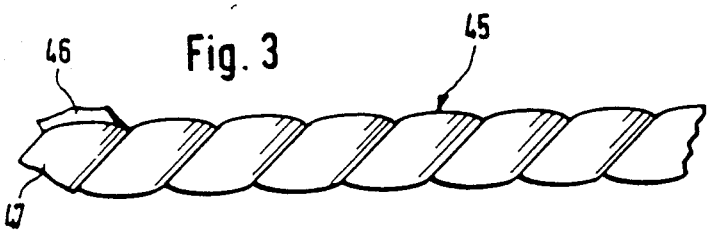
FIG. 3 is an enlarged diagrammatic representation of a twisted yarn formed in accordance with a preferred embodiment of the present invention using a pair of prestrengthened slivers according to FIG. 2.

The two yarn components 7, 10, that were wound on spool 50 as a double yarn 11, subsequently are processed into a twisted yarn 45, as shown very diagrammatically in FIG. 3. The twisted yarn 45 that consists of two strands 46, 47 of prestrengthened yarn or stress is produced by means of a twisting turn that is opposed to the winding-around direction of the fiber ends 44. During the twisting, not only the twisted strands 46, 47 are wound around one another, but a turn is also introduced into the twisted strands 46, 47.

Figure 4:
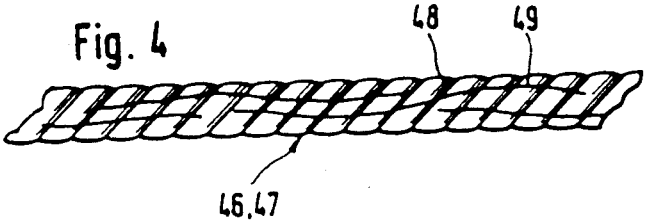
FIG. 4 is an enlarged, diagrammatic representation of a component of the finished twisted yarn of FIG. 3 depicting the twisting turn and orientation of the prestrengthened wrapped around fibers in the finished twisted yarn.

By means of this twisting turn, it is endeavored, as shown in FIG. 4 for one strand 46, 47 of twisted yarn, that the fibers 48 of the previously unturned core 43 have a twist. By means of this twist, the fiber ends 44 that were previously wound around the unturned core 43, see FIG. 2, are wound off so that then they extend essentially in longitudinal direction of the strand 46, 47 of twisted yarn and are located there as fiber ends 49. These fiber ends 49 that, with their beginning, are bound into the respective slivers, during the twisting, are also bound into the twisted yarn 45 so that they are not exposed.

A twisted yarn that is produced in this way has sufficient strength and distinguishes itself mainly by the fact that it is very voluminous and uniform. A primary advantage is that this yarn has an excellent textile feel.

Although the present invention has been described and illustrated in detail, it is to be clearly understood that the same is by way of illustration and example only, and is not to be taken by way of limitation. The spirit and scope of the present invention are to be limited only by the terms of the appended claims.

We claim:

1. A process for manufacturing a feed spool of prestrengthened slivers for a subsequent yarn twisting operation, comprising:

forming a prestrengthened sliver comprising a core made up of core fibers extending in a longitudinal direction of the prestrengthened sliver, said forming including winding fiber ends around the core in a helical manner with a predominate part of the fiber ends extending at a helical angle of slope with respect to a radial plane through the core which is 45° and greater, wherein said fiber ends are wound around continuously and uniformly along the length of the respective cores to facilitate a subsequent yarn twisting operation on the prestrengthened sliver with the fiber ends wound around the core being substantially wound off the core.

2. A process according to claim 1, comprising forming a second prestrengthened sliver by a similar process so that two prestrengthened slivers are formed in side-by-side parallel relationship with one another.

3. A process according to claim 2, wherein the fiber ends are wound around both cores in the same direction.

4. A process according to claim 2, wherein said forming includes pneumatic false twisting, further comprising twisting the prestrengthened slivers together with one another with a twisting turn opposed to the winding around direction of the fiber ends during the pneumatic false twisting such that at least some of the fiber ends previously helically wound around the cores are wound off the respective cores and extend substantially longitudinally of the twisted yarn comprised of the two slivers together.

5. A process according to claim 4, wherein drawing and prestrengthening is performed simultaneously for said two slivers with said slivers traveling in side-by-side relationship through a common drawing and prestrengthening unit, and wherein said prestrengthened slivers are wound onto a feed spool in side-by-side parallel relationship.

6. A process according to claim 2, wherein drawing and prestrengthening is performed simultaneously for said two slivers with said slivers traveling in side-by-side relationship through a common drawing and prestrengthening unit, and wherein said prestrengthened slivers are wound onto a feed spool in side-by-side parallel relationship.

* * * * *